US006388164B1

(12) United States Patent
Desmare et al.

(10) Patent No.: US 6,388,164 B1
(45) Date of Patent: May 14, 2002

(54) DMSO/BASE HYDROLYSIS METHOD FOR THE DISPOSAL OF HIGH EXPLOSIVES AND RELATED ENERGETIC MATERIALS

(75) Inventors: Gabriel W. Desmare; Dillard M. Cates, both of Amarillo, TX (US)

(73) Assignee: Mason & Hanger Corporation, Amarillo, TX (US)

( * ) Notice: Subject to any disclaimer, the term of this patent is extended or adjusted under 35 U.S.C. 154(b) by 0 days.

(21) Appl. No.: 09/002,907

(22) Filed: Jan. 5, 1998

(51) Int. Cl.[7] ..... A62D 3/00
(52) U.S. Cl. ..... 588/203; 588/202
(58) Field of Search ..... 149/5, 8, 48, 55, 149/124, 109.6; 588/202, 203

(56) References Cited

U.S. PATENT DOCUMENTS 5,445,690 A * 8/1995 Wulfman ..... 149/109.6
5,516,971 A * 5/1996 Hurley ..... 588/203

OTHER PUBLICATIONS

Spontarelli et al., "Destruction of Waste Energetic Materials Using Base Hydrolysis," Proceedings of the 1993 Incineration Conference (Knoxville, TN, May 3–7, 1993), p. 787.*
Phelan et al., "Base Hydrolysis Process for Treating High Explosives Status Report, " Dept. of Energy, DOE/AL/65030–9606, Distribution Category UC–741, 45 pages, Aug. 1996.*
Bachmann, Horton, Jenner, MacNaughton, Scott, "Cyclic and Linear Nitramines Formed by Nitrolysis of Hexamine," *J. Am Chem. Soc.,* 73:2769, 1951.
Hoffsommer, Kubose, Glover, Kinetic Isotope Effects and Intermediate Formation for the Aqueous Alkaline Homogeneous Hydrolysis of 1,3,5,–Triaza–1,3,5–trinitrocyclohexane (RDX), *J. Phys. Chem.,* 81(5):380, 1977.
Croce and Okamoto, "Cationic Micellar Catalysis of the Aqueous Alkaline Hydrolyses of 1,3,5–Triaza–1,3,5–trinitrocyclohexane and 1,3,5,7–Tetraaza–1,3,5,7–tetranitrocyclooctane," *J. Org. Chem.,* 44(13):2100–2103, 1979.
Spontarelli, Buntain, Sanchez, Benziger, "Destruction of Waste Energetic Materials Using Base Hydrolysis," Proceedings of the 1993 Incineration Conference (Knoxville, TN, May 3–7, 1993), p. 787.
Heilmann, Stenstrom, Hesselmann, Wiesmann, "Kinetics of the Aqueous Alkaline Homogenous Hydrolysis of High Explosive 1,3,5,7–Tetraaza–1,3,5,7–Tetranitrocyclooctane (HMX)," *Wat. Sci. Tech.* 30(3):53, 1994.
Skidmore, Dell'Orco, Flesner, Kramer, Spontarelli, "Chemical Destruction of HMX–Based Explosives with Ammonium Hydroxide," Los Alamos National Laboratory Report LA–13003, Distribution Category UC–741, 22 pages, Sep. 1995.
Heilmann, Wiesmann, Stenstrom "Kinetics of the Alkaline Hydrolysis of High Explosives RDX and HMX in Aqueous Solution and Adsorbed to Activated Carbon," *Environ. Sci. & Technol.,* 30(5):1485, 1996.
Phelan, Desmare, Quinlin, "Base Hydrolysis Process for Treating High Explosives Status Report," Dept. Of Energy, DOE/AL/65030–9606, Distribution Category UC–741, 45 pages, Aug. 1996.

* cited by examiner

*Primary Examiner*—Steven P. Griffin
*Assistant Examiner*—Eileen E. Nave
(74) *Attorney, Agent, or Firm*—Fulbright & Jaworski, LLP

(57) ABSTRACT

High explosives and related energetic materials are treated via a DMSO/base hydrolysis method which renders them non-explosive and/or non-energetic. For example, high explosives such as 1,3,5,7-tetraaza-1,3,5,7-tetranitrocyclooctane (HMX), 1,3,5-triaza-1,3,5-trinitrocyclohexane (RDX), 2,4,6-trinitrotoluene (TNT), or mixtures thereof, may be dissolved in a polar, aprotic solvent and subsequently hydrolyzed by adding the explosive-containing solution to concentrated aqueous base. Major hydrolysis products typically include nitrite, formate, and nitrous oxide.

30 Claims, 2 Drawing Sheets

DMSO/BASE HYDROLYSIS METHOD FOR THE DISPOSAL OF HIGH EXPLOSIVES AND RELATED ENERGETIC MATERIALS

This invention was made with government support under Contract No. DE-AC04-91AL65030 awarded by the U.S. Department of Energy. The government has certain rights in the invention.

BACKGROUND OF THE INVENTION

1. Field of the Invention

The present invention relates generally to the field of treatment of hazardous waste for disposal. More particularly, it relates to a method of treating high explosives and related energetic materials via base hydrolysis to render them non-explosive and/or non-energetic.

2. Description of Related Art

The end of the Cold War has brought a concomitant need for the treatment and disposal of large inventories of high explosives and associated high explosives waste, particularly in the United States, Europe, and countries of the former Soviet Union. Under the terms of numerous treaties such as the Intermediate-range Nuclear Forces Treaty and the Strategic Arms Reduction Treaties, stockpiles of weapons, including nuclear weapons, must be dismantled and/or demilitarized (Heilmann et al., 1994). These demilitarization activities generate large amounts of high explosives, including 1,3,5,7-tetraaza-1,3,5,7-tetranitrocyclooctane (HMX), 1,3,5-triaza-1,3,5-trinitrocyclohexane (RDX), and 2,4,6-trinitrotoluene (TNT), as well as explosives-contaminated processing water, soils and groundwater.

At the end of 1992, the United States Department of Defense possessed more than 317,000,000 kg of high explosives requiring treatment and disposal (Byrd and Humphreys). The majority of these explosives were RDX- and TNT-based. Through the dismantlement of nuclear weapons, the United States Department of Energy generates an additional 50,000 kg per year of high explosives waste, most of which is HMX-based.

Currently most high explosives are treated by the method of open burning/open detonation. In fiscal year 1992, 80% of the 56,000,000 kg of high explosives demilitarized by the United States Department of Defense were treated by this method (Byrd and Humphreys).

Alkaline hydrolysis of high explosives has been identified as a possible alternative to open burning/open detonation technology (Spontarelli et al.). In this approach, high explosives are typically placed in a molar excess of aqueous base solution and the mixture is heated and agitated for several hours until all high explosives have been hydrolyzed. However, the extremely low solubility of high explosives in water limits the rate of this reaction, and the usefulness of this method for large scale processing of high explosives is correspondingly limited. For example, the solubility of HMX in water at 90° C. is only about 286 parts per million (ppm). This means that in the alkaline hydrolysis of HMX, only a tiny fraction of the explosive is solvated and available for contact and reaction with aqueous base at any given time. In order to treat large amounts of high explosives in a timely manner, extremely large reaction vessels containing similarly large amounts of aqueous base solution are therefore required, making the alkaline hydrolysis process both unwieldy and prohibitively costly. Furthermore, the alkaline hydrolysis of explosives is difficult to control precisely because the explosives are added in solid (granular) form directly to an aqueous base solution in which they are only sparingly soluble. This can lead to localized exotherms in the reaction mixture, causing foaming and other undesirable phenomena, such as an uncontrollably rapid reaction.

SUMMARY OF THE INVENTION

The present invention overcomes problems in the prior art by providing a method for treating high explosives in which the explosives are fully dissolved prior to a hydrolysis step, thus permitting good contact of the explosives with aqueous base, resulting in a rapid hydrolysis reaction which proceeds to completion. Advantageously, because the explosive is already fully dissolved prior to addition to the base solution, the rate of the hydrolysis reaction is exponentially faster, permitting the use of lower reaction temperatures if necessary. Another advantage of the method of the present invention is that a more concentrated base mixture may be employed, thus allowing a reduction in equipment size and further allowing a reduction in the number of times the base solution must be changed out.

In one broad respect, this invention is a method for treating explosive materials to render them non-explosive. In another broad respect, this invention is a method for treating energetic materials, such as rocket fuels, to render them non-energetic. In this application, the terms "explosive" and "high explosive" are used interchangeably, and are defined as a substance usually characterized by chemical stability but which may be made to undergo rapid chemical change without an outside source of oxygen, whereupon a quantity of energy, usually accompanied by hot gases, is evolved. As used herein, the term "energetic material" is defined as any chemical compound which, when subjected to heat, impact, friction, shock, or other suitable initiation, undergoes a very rapid chemical change with the evolution of large volumes of heated gases that exert pressure in or on the surrounding medium.

In the practice of one typical embodiment of the present invention, an explosive is dissolved in a polar, aprotic organic solvent to form an explosive-containing solution. The explosive-containing solution is added to a basic aqueous solution to form a reaction mixture, such that a hydrolysis reaction may occur between the explosive and the base. Typically, the reaction mixture is stirred and maintained at a temperature sufficient to ensure that the hydrolysis reaction proceeds to completion. An amount of aqueous acid solution sufficient to neutralize the aqueous base is then added to the reaction mixture. Gaseous products of the hydrolysis reaction may be scrubbed prior to venting to the atmosphere, if necessary. The remaining reaction mixture, including hydrolysis products, then is filtered to remove any solids, including unreacted material, which may be present. If this solid residue contains any unreacted explosives, it may be added to another batch of explosives to be dissolved in a polar, aprotic solvent. If no explosives are present in the solid residue, it may be drummed and disposed as waste. The remaining liquid phase of the reaction mixture may be evaporated to remove any salts and distilled to separate any liquid hydrolysis products from the aqueous phase and the polar, aprotic organic solvent phase. Finally, the aqueous phase and the polar, aprotic organic solvent phase may be, at least partially, reused or recycled in subsequent batches of the inventive base hydrolysis method.

In one embodiment, the present invention is a method for hydrolyzing an explosive, including the steps of dissolving the explosive in a polar, aprotic organic solvent to form an explosive-containing solution, and adding the explosive-containing solution to a basic aqueous solution to form a mixture or reaction mixture, such that the explosive is hydrolyzed. In certain specific embodiments of the present invention, the polar, aprotic organic solvent is dimethylsulfoxide, and the reaction mixture comprises from about 65% to about 85% dimethylsulfoxide by volume.

Explosives which may be treated by the method of the present invention include, but are not limited to, 1,3,5,7-tetraaza-1,3,5,7-tetranitrocyclooctane, 1,3,5-triaza-1,3,5-trinitrocyclohexane, 2,4,6-trinitrotoluene, or mixtures the three.

In embodiments of the disclosed invention in which the explosive is 1,3,5,7-tetraaza-1,3,5,7-tetranitrocyclooctane and the solvent is dimethylsulfoxide, the explosive-containing solution comprises preferably less than about 450 g 1,3,5,7-tetraaza-1,3,5,7-tetranitrocyclooctane per liter of dimethylsulfoxide, and more preferably from about 200 g to about 280 g 1,3,5,7-tetraaza-1,3,5,7-tetranitrocyclooctane per liter of dimethylsulfoxide.

In embodiments of the disclosed invention in which the explosive is 1,3,5-triaza-1,3,5-trinitrocyclohexane and the solvent is dimethylsulfoxide, the explosive-containing solution comprises preferably less than about 460 g 1,3,5-triaza-1,3,5-trinitrocyclohexane per liter of dimethylsulfoxide, and more preferably from about 200 g to about 280 g 1,3,5-triaza-1,3,5-trinitrocyclohexane per liter of dimethylsulfoxide.

In embodiments of the disclosed invention in which the explosive is 2,4,6-trinitrotoluene and the solvent is dimethylsulfoxide, the explosive-containing solution comprises preferably less than about 435 g 2,4,6-trinitrotoluene per liter of dimethylsulfoxide, and more preferably from about 200 g to about 280 g 2,4,6-trinitrotoluene per liter of dimethylsulfoxide.

In other embodiments of the method of the present invention, the explosive may include at least one of a binder, a plasticizer, a stabilizer, or a mixture thereof. Specific examples of binders which may be treated by the method of the present invention include, but are not limited to, nitrocellulose and fluoroelastomers such as Viton A™. A specific example of a plasticizer which may be treated by the method of the present invention includes, but is not limited to, tris(2-chloroethyl) phosphate. A specific example of a stabilizer which may be treated by the method of the present invention includes, but is not limited to, diphenylamine.

In one embodiment of the disclosed invention, the base comprises sodium hydroxide. In this embodiment, the basic aqueous solution comprises preferably from about 1 M to about 15 M sodium hydroxide, and more preferably from about 8 M to about 10 M sodium hydroxide.

In other embodiments of the present invention, the basic aqueous solution is maintained at a temperature preferably between about 20° C. and about 100° C., and more preferably between about 60° C. and about 90° C. The explosive-containing solution is maintained at a temperature preferably between about 20° C. and about 100° C.

Advantageously, the rate of adding the explosive-containing solution to the basic aqueous solution may be controlled in order to minimize foaming of the mixture, and in order to regulate the temperature of the mixture.

In certain specific embodiments of the invention, the explosive may further include a glue, a sealant, or a mixture of the two. In certain other embodiments, the explosive may include explosives-contaminated soil, explosives-contaminated processing water, explosives-contaminated groundwater, or a mixture thereof In another typical embodiment, the present invention is a method for hydrolyzing an explosive to form hydrolysis products, including the steps of dissolving the explosive in a polar, aprotic organic solvent to form an explosive-containing solution and adding the explosive-containing solution to a basic aqueous solution to form a reaction mixture, such that the explosive is hydrolyzed. In other embodiments, the method of the present invention includes adding an acidic aqueous solution to the reaction mixture to neutralize the basic aqueous solution. Other aspects of the invention include separating the hydrolysis products from the reaction mixture, separating the polar, aprotic organic solvent and an aqueous phase from the reaction mixture, and recycling the polar, aprotic organic solvent and the aqueous phase.

In yet another typical embodiment, the present invention is a method for hydrolyzing an energetic material to form hydrolysis products, including the steps of dissolving the energetic material in a polar, aprotic organic solvent to form an energetic material-containing solution and adding the energetic material-containing solution to a basic aqueous solution to form a reaction mixture, such that the energetic material is hydrolyzed. In other embodiments, the method of the present invention includes adding an acidic aqueous solution to the reaction mixture to neutralize the basic aqueous solution. Other aspects of the invention include separating the hydrolysis products from the reaction mixture, separating the polar, aprotic organic solvent and an aqueous phase from the reaction mixture, and recycling the polar, aprotic organic solvent and the aqueous phase.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DESCRIPTION OF ILLUSTRATIVE EMBODIMENTS

Figure 1:
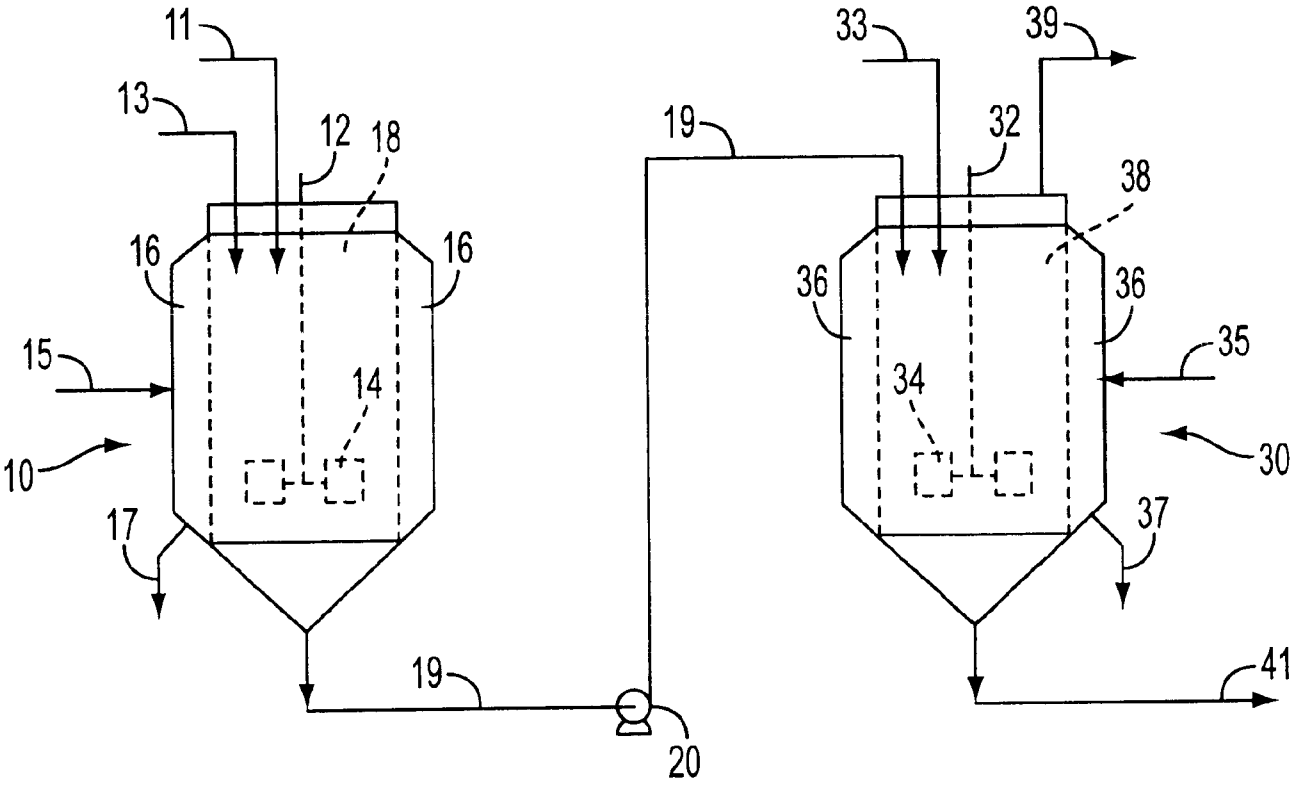
FIG. 1 shows a schematic diagram of a DMSO/base hydrolysis system.

As noted hereinabove, the present invention provides a method for treating high explosives and other energetic materials in which the explosives are fully dissolved prior to a hydrolysis step, thus permitting good contact of the explosives with aqueous base, resulting in a rapid hydrolysis reaction which proceeds to completion. As used herein, an "energetic material" is any chemical compound which, when subjected to heat, impact, friction, shock, or other suitable initiation, undergoes a very rapid chemical change with the evolution of large volumes of heated gases that exert pressure in the surrounding medium. These terms apply to materials that either detonate or deflagrate.

A "detonation" is defined herein as a violent chemical reaction involving a chemical compound or mechanical mixture, resulting in heat and pressure. A detonation is a reaction that proceeds through the reacted material toward the unreacted material at a supersonic velocity. The result of the chemical reaction is exertion of extremely high pressure on the surrounding medium, forming a propagating shock wave that is originally of supersonic velocity. When the material is located on or near the surface of the ground, a detonation is normally characterized by a crater.

A "deflagration" is defined herein as a rapid chemical reaction in which the output of heat is sufficient to enable the reaction to proceed and be accelerated without input of heat from another source. Deflagration is a surface phenomenon, with the reaction products flowing away from the unreacted material along the surface at subsonic velocity. The effect of a true deflagration under confinement is an explosion. Confinement of the reaction increases pressure, rate of reaction, and temperature and may cause transition into a detonation.

In the practice of one typical embodiment of the present invention, an explosive is dissolved in a polar, aprotic organic solvent to form an explosive-containing solution. Advantageously, the concentration of this is- solution is typically such that the solution cannot be made to detonate. The explosive-containing solution is added to a basic aqueous solution to form a reaction mixture, such that a hydrolysis reaction may occur between the explosive and the base. Advantageously, because the explosive is already fully dissolved prior to addition to the base solution, the rate of the hydrolysis reaction is exponentially faster, permitting the use of lower reaction temperatures if necessary. Another advantage of the method of the present invention is that a more concentrated base mixture may be employed, thus allowing a reduction in equipment size and further allowing a reduction in the number of times the base solution must be changed out. An additional advantage of the method of the present invention is that bulk explosives are not added directly to the basic aqueous solution, thus helping to eliminate foaming and localized exotherms in the reaction mixture. Because the explosive is fully dissolved, it can be added to the basic aqueous solution in a precisely controlled manner, allowing a similarly precise control of the temperature of the reaction mixture. Furthermore, dissolution of the explosive prior to addition to the base solution obviates the need for pulverizing large grains of explosive into a finer powder to enhance reaction rate. This is advantageous in that size reduction of large grains of explosive may be both hazardous and costly.

Typically, the reaction mixture is stirred and maintained at a temperature sufficient to ensure that the hydrolysis reaction proceeds to completion. An amount of acid sufficient to neutralize the aqueous base is then added to the reaction mixture, thereby quenching the reaction. Gaseous products of the hydrolysis reaction may be scrubbed prior to venting to the atmosphere, if necessary. The principal gaseous products of the method of the present invention usually comprise nitrogen, oxygen, $NO_x$ and traces of ammonia. The remaining reaction mixture, including solid and liquid hydrolysis products, is then filtered to remove any solid reaction residue or hydrolysis products which may be present. The filtered solid residue may be drummed and disposed as waste. Typically, this solid residue is not regulated as a hazardous solid waste under the terms of the Resource Conservation and Recovery Act (RCRA). The remaining liquid phase of the reaction mixture may be evaporated to remove any salts, and distilled to separate any remaining hydrolysis products from the aqueous phase and the polar, aprotic organic solvent phase. Finally, the aqueous phase and the polar, aprotic organic solvent phase may be at least partially separated from one another and at least partially reused or recycled in subsequent batches of the inventive base hydrolysis method.

Any energetic material or compound that may be hydrolyzed by a base is suitable for treatment by the method of the present invention. High explosives comprising the —$NO_2$ chemical moiety may be particularly well-suited for treatment by the disclosed DMSO/base hydrolysis method. Specific examples of suitable high explosives include, but are not limited to, 1,3,5,7-tetraaza-1,3,5,7-tetranitrocyclooctane (HMX), 1,3,5-triaza-1,3,5-trinitrocyclohexane (RDX), 2,4,6-trinitrotoluene (TNT), or mixtures thereof.

Explosives or high explosives formulations or mixtures comprising an energetic material or compound that may be hydrolyzed by a base are suitable for treatment by the method of the present invention. In particular, high explosives formulations comprising HMX, RDX, TNT, or mixtures thereof may be well-suited for treatment by the disclosed DMSO/base hydrolysis method. Typically, in addition to one or more high explosives, these formulations may contain other constituents such as binders, plasticizers, stabilizers, and other additives, as discussed hereinbelow. Specific examples of suitable high explosives formulations or mixtures include, but are not limited to, HMX-containing formulations such as PBX-9011, PBX-9404-3, PBX-9501, LX-04-1, LX-07-2, LX-09-1, LX-10-0, LX-10-1, LX-11, LX-14, and Octol 75/25; RDX-containing formulations such as PBX-9007, PBX-9010, PBX-9205, PBX-9407, PBX-9604, HBX-1, HBX-3, Comp A-3, Comp A-5, Comp B, Comp B-3, Comp C-3, Comp C-4, XTX-8004, H-6, Cyclotol 75/25, and Cyclotol 60/40; and TNT-containing formulations such as Pentolite 50/50, Minol-2, and Boracitol. In addition, it is contemplated that any rocket fuels, solid propellants, or other energetic materials comprising HMX, RDX, TNT, nitrocellulose, nitroguanidine, or mixtures thereof, may be suitable for treatment by the disclosed DMSO/base hydrolysis method.

As noted hereinabove, high explosives formulations that are suitable for treatment by the method of the present invention may include, in addition to one or more high explosives, one or more binders, plasticizers, stabilizers, other additives both inert and non-inert, or mixtures thereof. As used herein, the term "binder" is defined as a resin or cement-like material used to hold particles together and provide mechanical strength and/or to ensure uniform consistency, solidification, or adhesion to a surface coating. The term "plasticizer" is defined herein as an additive that gives an otherwise rigid plastic some degree of flexibility. The term "stabilizer," as used herein, denotes a substance that tends to maintain the physical and chemical properties of a material. Specific examples of binders which may be treated by the method of the present invention include, but are not limited to, nitrocellulose and fluoroelastomers such as Viton A™. Viton A™ is a registered trademark of E. I. DuPont de Nemours and Co., Wilmington, Del. A specific example of a plasticizer which may be treated by the method of the present invention includes, but is not limited to, tris(2-chloroethyl) phosphate (CEF). A specific example of a stabilizer which may be treated by the method of the present invention includes, but is not limited to, diphenylamine (DPA).

Any polar, aprotic solvent which can fully dissolve high explosives, high explosives formulations, or waste streams comprising high explosives or high explosives formulations, and which is fully miscible with water, may be used in the practice of the disclosed hydrolysis method. A specific example of a polar, aprotic solvent suitable for use in the method of the present invention includes, but is not limited to, dimethylsulfoxide (DMSO). Advantageously, DMSO is not a controlled substance, and it is readily obtainable from commercial sources. Advantageously, DMSO reacts minimally or not at all with strong bases such as sodium hydroxide, and it has a high heat of vaporization, meaning that evaporative loss of solvent during the hydrolysis process may be minimized. In embodiments of the disclosed invention in which the explosive comprises HMX and the solvent comprises DMSO, the explosive-containing solution comprises preferably less than about 450 g HMX per liter of DMSO, and more preferably from about 200 g to about 280 g HMX per liter of DMSO. In embodiments of the disclosed invention in which the explosive comprises RDX and the solvent comprises DMSO, the explosive-containing solution comprises preferably less than about 460 g RDX per liter of DMSO, and more preferably from about 200 g to about 280 g RDX per liter of DMSO. In embodiments of the disclosed invention in which the explosive comprises TNT and the solvent comprises DMSO, the explosive-containing solution comprises preferably less than about 435 g TNT per liter of DMSO, and more preferably from about 200 g to about 280 g TNT per liter of DMSO.

Bases useful in the practice of the disclosed method include any water soluble base suitable for hydrolyzing high explosives and related energetic materials. Specific examples include, but are not limited to, Group IA metal hydroxides such as lithium hydroxide, sodium hydroxide, potassium hydroxide, and cesium hydroxide. A preferred base in the practice of the instant DMSO/base hydrolysis method is sodium hydroxide (NaOH). In one embodiment, the basic aqueous solution comprises preferably from about 1 M to about 15 M sodium hydroxide, and more preferably from about 8 M to about 10 M sodium hydroxide. In order to ensure complete hydrolysis, the basic aqueous solution is usually provided in a molar excess relative to the amount of explosive being hydrolyzed. In one typical embodiment of the disclosed method aqueous sodium hydroxide base or caustic is provided at about a 15% molar equivalent excess relative to the level of corresponding oxygenate impurities present. In this regard, a 15% molar equivalent excess is an approximate figure and it will be appreciated by one of skill in the art that amounts of base may be varied substantially without exceeding the scope of the disclosed method. Typically, between about 1% and about 200%, more typically between about 5% and about 50%, and most typically between about 10% and about 20%, molar equivalent excess of base, relative to explosives levels, may be employed in the practice of the disclosed method. Furthermore, it will be appreciated with benefit of the present disclosure that any amount (including stoichiometric and substoichiometric amounts) of base suitable for hydrolyzing high explosives or high explosives formulations may be employed.

The rate of addition of the explosive-containing mixture to the basic aqueous solution is typically chosen to control reaction temperature and to minimize foaming. Foaming is undesirable because the foam may contain unreacted explosives, in the form of very small particles with high surface areas. The higher the foaming rises in the reaction vessel, the more small explosives particles may be deposited, as a thin film, when the foaming recedes. Since this thin film remains above the liquid level of the reactor, none of the explosives in the film are likely to be hydrolyzed. This thin film of explosives may be very susceptible to friction as a means of ignition. In general, the higher the surface area of the explosives particle, the greater the chance of some type of friction causing ignition. Although a solvent such as DMSO is not highly volatile or flammable, a spark or other ignition means is still preferably avoided, for the reasons outlined above.

An additional safety concern related to the choice of reaction conditions, including choice of the rate of addition of the explosive-containing mixture to the basic aqueous solution, is the avoidance of localized exotherms in the reaction mixture. A localized exotherm may initiate an uncontrolled chemical reaction and possibly lead to a detonation or deflagration of the a solid piece of explosive or energetic material present in the reaction mixture. A localized exotherm may arise from non-uniform heating or heat conduction. A localized exotherm may also present a hazard if the explosives precipitate out of solution. At high concentrations of base and high concentrations of explosives in DMSO solution, high feed rates may result in the explosives precipitating out of solution.

It is important to recognize that heating and processing of explosives is potentially dangerous for several reasons. First, elevated temperature may increase the sensitivity of an explosive to other stimuli such as impact, shock, friction, and static electricity. Second, at or above a critical temperature of the system, a runaway chemical reaction may occur that may produce an explosion (detonation or deflagration), or at least fire. Third, elevated temperature of an explosive in a sealed or semi-sealed container, such as a reactor vessel may cause gas generation and subsequent pressure rupture of the containment, even at temperatures below a critical temperature. Fourth, chemically incompatible or reactive materials, which may be present as accidental contaminants, as components of the formulation, or in external contact with the explosive, can intensify the preceding dangers or cause them to occur at lower temperatures. Fifth, as noted above, non-uniform heating of a reaction mixture can cause excessively hot regions in the explosives; causes of this may include inadequate agitation of fluid explosives, non-uniform heating, and non-uniform heat conduction.

To mitigate some of these hazards during the practice of the DMSO/base hydrolysis process, a number of factors are typically taken into account when choosing the feed rate of the explosive-containing mixture to the basic aqueous solution. First, the type of explosive that is being processed is typically taken into consideration; some explosives are more exothermic or energetic that others. For example, HMX is more energetic than RDX, which in turn is more energetic than TNT. Also, the quantity of explosive dissolved in DMSO or other solvent is typically taken into consideration. The higher the concentration of explosives, in general, the lower the feed rate required to obtain optimum conditions. As used herein, "optimum conditions" are those in which no foaming occurs, no precipitation of dissolved explosive occurs, and complete hydrolysis or conversion of the explosive into non-energetic material occurs. Also, the concentration of base is taken into consideration. The higher the concentration of the base, in general, the lower the feed rate required to obtain optimum conditions. As noted hereinabove, at high concentrations of base and high concentrations of explosive in the DMSO or other solvent, high feed rates may cause the explosive to precipitate out of solution. The heat generated by the exothermic hydrolysis reaction is also taken into account. In general, the more concentrated the explosives in DMSO or other solvent, and/or the more concentrated the base, the greater the heat generated by the reaction, and the greater the chance of foaming. Foaming is a liquid surface tension phenomenon, and proper agitation may reduce or eliminate this hazard. Factors typically considered are size and type of impeller blade as well as how far above the bottom of the reactor vessel the impeller should be placed. Other factors affecting degree of foaming include the physical shape of the reactor vessel and the number and type of baffles along the vessel wall.

In the practice of the disclosed DMSO/base hydrolysis process, equipment (reaction vessels, pumps, pipes, etc.) is typically chosen to minimize the risk of a spark occurring, whether from frictional sources, static charge sources, or other sources. To prevent a static spark discharge all equipment is typically bonded and grounded to water pipes, ground cones, buried copper plates, driven ground rods, or down conductors of lightning protection systems. All conductive parts of equipment may be bonded so that resistance to ground does not exceed 25 ohms, unless resistance is not to exceed 10 ohms because of the lightning protection installation. To restrict ignition sources such as sparks from electrical faults and to control surface temperatures of electrical equipment, all electrical equipment typically conforms to Class I, division I and Class II, Division 1 of the National Electric Code. This is done because explosives dusts or vapors may collect on electrical appliances in the vicinity of the reaction vessels. In choosing equipment for the practice of the disclosed DMSO/base hydrolysis process, screw-threads, recesses, or cracks that may be exposed to explosives contamination are usually avoided, because threaded fittings and fasteners can indirectly cause the ignition of accumulations of explosives by means of friction. Therefore, all piping and equipment, including reaction vessels, is usually equipped with flanged connectors and inspection ports. Heating is usually supplied by means of steam, hot water, or friction air.

Equipment is typically chosen which is resistant to the corrosive effects of concentrated base solution. Additionally, all equipment is preferably inert to the effects of organic solvents such as DMSO. For example, reactor vessels are usually glass lined to prevent the concentrated base solution from reacting with the vessel wall to form metal hydroxides. Such a reaction with a vessel wall can both corrode the reactor vessel and reduce the efficiency of the base hydrolysis process. Pipes or ducts through which explosives are conveyed usually have long radius bends with a centerline radius at least four times the diameter of the pipes or ducts. Piping may comprise permanent piping consisting of carbon or stainless steel with flanged fittings, or alternatively, flexible Teflon™ tubing (Teflon™ is inert to DMSO) with an outer lining of stainless steel braiding with flanged fittings.

FIG. 1 shows a schematic diagram of one typical embodiment of the disclosed method for treating high explosives. As shown, explosive 11 and dimethylsulfoxide 13 are introduced into dissolver vessel 10. Impeller 14 turns on impeller axis 12 to agitate the explosive and dimethylsulfoxide and promote formation of an explosive-containing solution within interior 18 of dissolver vessel 10. Dissolver vessel 10 features a steam input 15 and a steam jacket 16 through which steam may circulate to warm the contents of interior 18, if necessary, further promoting dissolution. Steam and condensate may exit via steam jacket 16 through steam output 17.

Explosive-containing solution 19 is pumped from dissolver vessel 10 to reactor vessel 30 by means of pump 20. Explosive-containing solution 19 and basic aqueous solution 33 are introduced into reactor vessel 30. Impeller 34 turns on impeller axis 32 to agitate the explosive-containing solution and the basic aqueous solution promotes formation a reaction mixture within interior 38 of reactor vessel 30. Reactor vessel 30 features a steam/cooling water input 35 and a steam/cooling water jacket 36 through which steam or cooling water, whichever is necessary, may circulate to warm or cool the contents of interior 38, promoting a hydrolysis reaction between the explosive and the base. Steam and condensate or cooling water may exit steam/cooling water jacket 36 through steam/cooling water output 37.

Following completion of the hydrolysis reaction, acid (not shown) may be introduced into reactor vessel 30 to neutralize base present in the reaction mixture. Gaseous products of the hydrolysis reaction may exit reactor vessel 30 via gaseous product output 39. After exiting reactor vessel 30, the gaseous products may optionally pass through a scrubber, not shown, to remove water soluble components of the gaseous products. The remainder 41 of the reaction mixture, comprising liquid and solid hydrolysis products, as well as dimethylsulfoxide and basic aqueous solution, is removed from reactor vessel 30 for separations, not shown. Typically, remainder 41 may be filtered or processed in a rotary evaporator to isolate solid components and salts in solution from the aqueous and organic phases. The aqueous and organic phases may be separated by, for example, fractional distillation, and reused in subsequent hydrolysis reactions.

EXAMPLES

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

The analyses of the products of these experiments were conducted on several different instruments. HMX was analyzed by a Laboratory Data Control (LDC) 7800 Series high pressure liquid chromatograph (HPLC). The reverse-phase eluent was a mixture of 55% water by volume and 45% HPLC grade acetonitrile. The column used was a 25×4.6 mm Hypersil octadecylsilane (ODS) column with 3 $\mu$m packing. The detector was a Milton Roy variable-wavelength UV detector set at 230 nm. Ions including formate, nitrate, and nitrite were analyzed on a Dionex ion chromatograph (IC), with deionized water and 70 mM sodium borate as the eluent. Solid and liquid product phases were analyzed by nuclear magnetic resonance (NMR) and HPLC mass spectrometry for decomposition products. Mass spectrometry was used to identify and to find the percent composition of gases evolved in these experiments.

The chemicals used to perform the experiments were distilled water, Kodak HPLC grade DMSO, and Fisher reagent grade sodium hydroxide pellets. The high explosives and high explosives formulations used were weapons grade explosives.

Example 1

This example provides typical reaction conditions, reactant and product stoichiometries, and conversion efficiencies for the disclosed DMSO/base hydrolysis method for treating high explosives and related energetic materials, as implemented on a relatively small experimental scale in the laboratory.

First, explosives were dissolved in DMSO to form an explosive-containing solution, then the explosive-containing solution was added to aqueous sodium hydroxide (NaOH). Typically, an 18% solution by weight of explosive in DMSO was prepared, and aliquots of this solution were gradually added, with stirring, to a stoichiometric excess of 9 M aqueous NaOH at temperatures ranging from ambient to 110° C. Experiments were performed using HMX and also the PBX 9404 and LX-10 (95% by weight HMX, 5% by weight Viton binder) explosives formulations.

Generally, more than 99% of the HMX was eliminated after 5 minutes, even at ambient temperature. This is illustrated in Table 1 for the explosives formulations PBX 9404 and LX-10 dissolved in DMSO. The reactions employed 9 M aqueous NaOH. Each value in Table 1 is the average of two assays on the same sample.

TABLE 1

Hydrolyses at Ambient Temperature

| Explosive Formulation Used | Conversion of HMX (%) |
|---|---|
| PBX 9404 | 100.0 |
| LX-10 | 99.7 |

The results of this example generally support the observations of other researchers (Croce and Okamoto; Spontarelli et al.) that 4 moles of NaOH is required to hydrolyze each mole of HMX. For example, in three experiments in which the conversion of HMX was greater than 99% , molar ratios of NaOH to explosive were observed to vary from about 3.6 to about 4.1.

Another experiment was performed by adding increasing amounts of HMX solution to fixed volumes (20 mL each) of 9 M NaOH, allowing the reaction to proceed at room temperature until foaming was no longer observed (about 5 minutes). 100 mL of water was then added to precipitate any unreacted HMX. The results are shown in Table 2 and support the contention that the necessary ratio of NaOH to HMX for complete hydrolysis is about 4.

TABLE 2

Hydrolysis of 0.687M HMX in DMSO by Mixing With 20 mL of 9M NaOH at Ambient Temperature

| Volume of HMX (mL) | moles NaOH mole HMX | Unreacted HMX? |
|---|---|---|
| 50 | 5.23 | no |
| 60 | 4.36 | no |
| 70 | 3.74 | yes |
| 80 | 3.27 | yes |
| 100 | 2.62 | yes |

Figure 2:
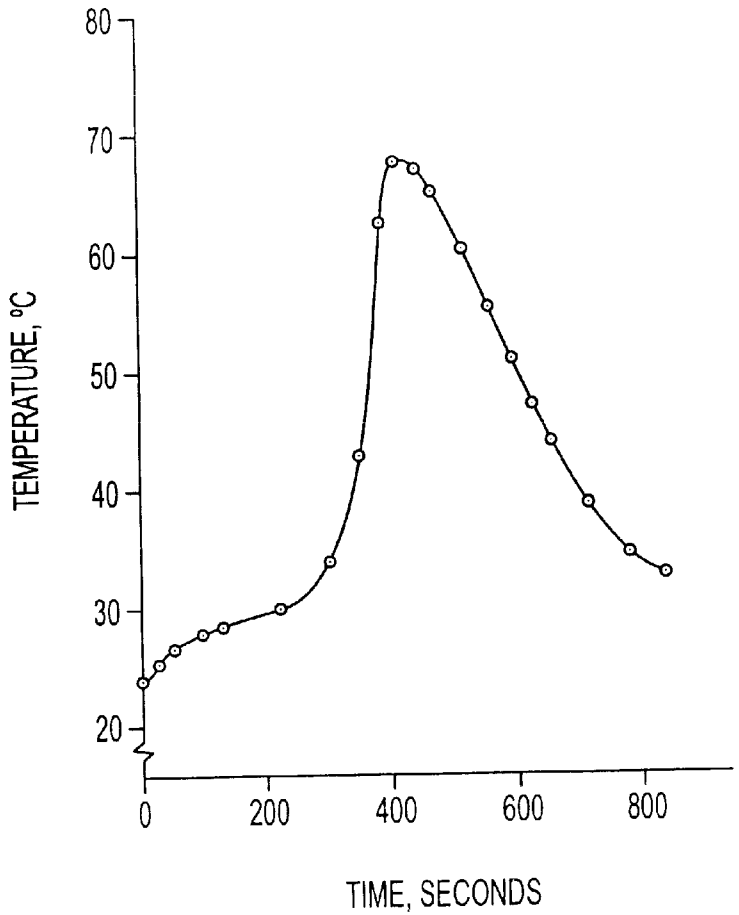
FIG. 2 shows a plot of temperature versus time for the base hydrolysis reaction of HMX dissolved in DMSO with 9 M sodium hydroxide solution.

Above 50° C., the hydrolysis reaction was complete within the time of mixing. This was demonstrated by semi-batch experiments in which 60 mL of HMX solution (from 237.3 g HMX in 1000 mL DMSO) were added to 20 mL of 9 M NaOH solution. The DMSO solution was added 3 mL at a time at 30 second intervals. The hydrolysis reaction was conducted in a jacketed beaker cooled with tap water (23° C.). The temperature of the solution is shown as a function of time in FIG. 2. Note that during addition of the first 21 mL of HMX solution (first 210 s), the reaction proceeded slowly and unreacted HMX accumulated in the beaker. The addition of HMX to NaOH resulted in only gradual warming of the reaction mixture. When the temperature reached 37° C., the reaction became extremely rapid (nearly complete within seconds) and the accumulated HMX was then consumed within 75 seconds, corresponding to the leading edge of the peak in FIG. 2. This shows that a practical temperature for the hydrolysis reaction is at least above 40° C. and it also shows that vigorous mixing should be maintained. Once the peak of 68° C. was reached, the rate of heat loss exceeded the rate that heat was being produced by the further additions of HMX solution, and the solution cooled gradually. However, HMX was still being consumed within seconds after it was added, until the temperature dropped below 37° C.

Example 2

This example shows the effect of varying sodium hydroxide concentration upon the inventive DMSO/base hydrolysis method. Typically, when the concentration of NaOH was 9 M or greater, over 99.5% of the HMX was destroyed within the time of mixing. However, when the concentration was 8 M or less, only 20–40% of the HMX was destroyed.

In the most definitive experiment, eight 10 mL aliquots of DMSO containing 2.136 g of PBX 9404 each were treated with 20 mL of aqueous NaOH solutions with concentrations ranging between about 1.5 M and about 9 M. The NaOH solution was stirred in gradually over a 20 minute period. Each reaction mixture was initially at ambient temperature. As soon as the last of the NaOH solution was added, the mixture was filtered to recover unreacted solids and the solids were weighed and analyzed to determine the amount of HMX that remained, if any. As shown in Table 3, the conversion of HMX increased abruptly when the concentration of NaOH solutions was above 8 M, going from 26.5% to 99.5% or greater. This discontinuous behavior may be due to changes in solubility of the HMX.

TABLE 3

Hydrolysis of PBX 9404 Dissolved in DMSO

| NaOH concentration (mol/L) | Molar ratio (NaOH/HMX) | Conversion of HMX (%) |
|---|---|---|
| 1.5 | 3.5 | 20.0 |
| 3.0 | 6.9 | 26.1 |
| 5.0 | 13.8 | 39.1 |
| 8.0 | 22.2 | 26.5 |
| 9.0 | 24.9 | 100.0 |
| 10.0 | 27.7 | 99.5 |
| 12.0 | 33.3 | 99.8 |
| 15.0 | 41.6 | 100.0 |

Example 3

This example shows that the major solid phase reaction products of the DMSO/base hydrolysis process typically include acetate, formate, chloride, nitrite, and nitrate. This is demonstrated for two different high explosive formulations, LX-10 and PBX 9404.

A solution of 17.7% by weight LX-10 in DMSO (0.672 M) was added to 9 M aqueous NaOH in a stoichiometric amount over a 5 minute period at ambient temperature, producing a basic (pH 8–9) product mixture. The solids (70.7 g) recovered from the reaction mixture by evaporating it to dryness were assayed twice using ion chromatography. The results appear in Table 4. Note that the concentrations shown are mg of ion per g of solid residue. The solid residue isolated from the hydrolysate contained only 0.27% by weight unreacted HMX, which implies over 99.7% conversion of HMX.

TABLE 4

Hydrolysis of LX-10 Dissolved in DMSO With 9.0M NaOH

| Assay | Acetate (mg/g) | Formate (mg/g) | Chloride (mg/g) | Nitrite (mg/g) | Nitrate (mg/g) |
|---|---|---|---|---|---|
| First | <4.96 | 159.0 | 3.7 | 259.2 | 0 |
| Second | <4.87 | 153.0 | 5.7 | 201.5 | 0 |

A solution of 17.7% by weight PBX 9404 in DMSO (0.687 M) was added to a 9 M aqueous NaOH solution at ambient temperature over a 12 minute period, yielding a reaction mixture of pH 7–8. The solids (74.3 g) recovered by evaporating the reaction mixture to dryness were analyzed by ion chromatography. The results are shown in Table 5, where concentrations are reported as mg ion per g of solid residue. The solid residue contained no unreacted HMX, which implies 100% conversion of HMX.

TABLE 5

Hydrolysis of PBX 9404 Dissolved in DMSO With 9.0M NaOH

| Assay | Acetate (mg/g) | Formate (mg/g) | Chloride (mg/g) | Nitrite (mg/g) | Nitrate (mg/g) |
|---|---|---|---|---|---|
| First | <4.93 | 152.1 | 10.2 | 237.4 | 13.7 |
| Second | <4.66 | 138.0 | 10.2 | 203.3 | 17.9 |

The binder and plasticizer of PBX 9404, nitrocellulose and CEF respectively, dissolve in DMSO and are destroyed in the sodium hydroxide solution along with the HMX. For LX-10, the binder is Viton A™, which was readily separated from the HMX because it is less soluble in DMSO and settled out of solution prior to the hydrolysis step.

Nitrate was found in the solid residues from hydrolysis of PBX 9404; nitrate was not detectable in the products from hydrolysis of LX-10. This may be explained by assuming that nitrate arises solely from the nitrocellulose binder in PBX 9404; LX-10 contains no nitrocellulose. These findings are in agreement with findings of other researchers (Spontarelli et al.).

The chloride found in the products may be partially attributable to the plasticizer, CEF, although chloride was also found in the products from LX-10, which contains no CEF. Chloride may also have been present as an impurity in the NaOH. Interestingly, CEF is completely destroyed during the hydrolysis reaction, as revealed in analyses by an independent EPA-certified laboratory, which showed that less than 300 ppm total halogenated organic carbon remained in the reaction mixtures.

TABLE 6

Product Yields from the Hydrolysis of PBX 9404 and LX-10 in DMSO Using 9.0M Aqueous NaOH at Ambient Temperature

| Explosive Used | Conversion of HMX (%) | Formate (%) | Nitrite (%) | Nitrate (%) |
|---|---|---|---|---|
| PBX 9404 | 100.0 | 25.5 | 21.6 | 0.9 |
| PBX 9404 | 100.0 | 23.2 | 18.5 | 1.6 |
| LX-10 | 95.0 | 28.8 | 22.9 | 0.0 |
| LX-10 | 95.0 | 27.6 | 17.7 | 0.0 |

In calculating the theoretical yields shown in Table 6, four assumptions were made: (1) CEF was not converted to formate, nitrite or nitrate; (2) the Viton binder in LX-10 amounted to 5% of the total LX-10 present and was inert; (3) all nitrogen in HMX and nitrocellulose could go to nitrite; and (4) all carbon in HMX could be converted to formate.

Within the experimental precision associated with the results in Table 6, the yields of formate and nitrite are the same for PBX 9404 and LX-10. That the yields of formate from PBX 9404 are so far below 100% of theoretical cannot be fully explained by postulating that some of the formate was lost as formic acid when the reaction mixture (pH 7–8) was evaporated to dryness. Such loss is even less readily explained in the case of LX-10, because that reaction mixture was at pH 8–9, a condition wherein formic acid is almost entirely converted to formate ion. Moreover, no formate was found in any of the distillates or any of the cold trap condensates after the evaporations were completed. Some of the sodium formate may have been decomposed. However, formate is stable at least to its melting point (253° C.), and the highest temperature employed in this example was only 110° C.

The low yields of nitrite cannot be readily explained by assuming that sodium nitrite decomposed during the evaporation step; sodium nitrite melts at 271° C. and decomposes at 320° C.

It is likely that much of the carbon and nitrogen was converted to gaseous products during the hydrolysis reaction. This is consistent with the observation of foaming during the hydrolysis reaction.

Example 4

This example describes bench-scale experiments which were performed to determine the feasibility of a continuous, flow-through hydrolysis process.

Solutions of PBX 9404 (from 237 g PBX 9404 in 1000 mL DMSO) and 9.0 M aqueous NaOH were pumped simultaneously into a tube reactor consisting of two water-jacketed condensers arranged vertically and in sequence. Various feed rates of the two solutions were employed. Three jacket-water temperatures were employed, but these cannot be taken as the reaction temperatures, because the reaction temperature was not constant. That was because the feed solutions entered at ambient temperature, considerably below the jacket temperature, then warmed as they passed through the reactor. Indeed, it is unknown whether the temperature remained below the jacket temperature or possibly exceeded it at some point within the tubes.

The conditions of the experiments and the conversions that were measured are shown in Table 7. The mean residence times (reactor volume/total flow rate of feeds) were calculated from the volumes of the tubes inside the condensers (50 mL each) and the volume of the tee where gas and hydrolysate separated (10 mL). It is not surprising that the conversion increased to 100% when the temperature and residence time were increased.

TABLE 7

Continuous Hydrolysis of PBX 9404

| Reactor Temperature (° C.) | | Conversion | Feed Rates mL/min | | Residence | molNaOH |
|---|---|---|---|---|---|---|
| Jacket | Exit | of HMX (%) | HMX | NaOH | time (sec) | mol HMX |
| 50 | Unknown | <75 | 20 | 60 | 83 | 39 |
| 70 | 70 | 75 | 20 | 60 | 83 | 39 |
| 90 | 86 | 100 | 20 | 17 | 178 | 11 |

A reaction temperature of 70° C. appeared to be adequate for practical purposes. At that temperature, and at the feed rates employed, the conversion of HMX was about 75% . Assuming pseudo-first-order kinetics (because NaOH is usually in large excess), the overall conversion efficiency could be increased to 94% just by doubling the length of the reactor or, equivalently, by doubling the residence time.

Example 5

This example shows that the disclosed DMSO/base hydrolysis method for treating high explosives and related energetic materials may be scaled up for treatment of large samples weighing on the order of 30 pounds. The same processes and materials used in the laboratory experiments described hereinabove were scaled-up for use in the pilot plant. To assure complete hydrolysis of the high explosive, a 10% molar excess NaOH aqueous solution was used, and the reactor was held at hydrolysis temperature (typically between about 60° C. and about 100° C.) for up to an hour and longer after adding the high explosive or high explosive formulation. All processes took place at ambient pressure. After the reaction mixtures cooled to room temperature, they were neutralized to pH 6–8 using either concentrated sulfuric acid or dilute hydrochloric acid. Following neutralization, the reaction mixtures were filtered. The filtrate was transferred into 55-gallon drums for later disposal.

The reactions were performed in a 50-gallon, steam-jacketed, glass-lined reactor manufactured by Pfaudler. Aqueous NaOH (9 M)solution (7.5 gallons) was poured into the reactor and heated to over 60° C. PBX 9404, 15.7 kg, was dissolved in 17.2 gallons of DMSO to form an explosive-containing solution. This explosive-containing solution was added to the caustic (NaOH solution), with constant agitation, over a period ranging from 50 to 100 minutes. It was necessary to heat the reactor with steam to maintain an elevated temperature from the outset of the experiment. When all PBX 9404 had been added, agitation continued while the mixture was allowed to cool to below 40° C.

After most of the experiments in this example, there was no unreacted HMX present in the reaction mixture. In a few instances, less than 0.3% of the high explosives remained in the reaction mixture. The amount of residual HMX was independent both of the rate at which the explosive-containing solution was added and the volume of 1 N hydrochloric acid used to neutralize the reaction mixture. (see Table 8). Significant foaming was observed during the neutralization process.

TABLE 8

Hydrolysis of PBX 9404 in DMSO Using 9M Aqueous NaOH

| Addition of PBX | | Acid to | Residual |
|---|---|---|---|
| Rate (L/min) | Total Time (min) | Neutralize (gal) | HMX (%) |
| 0.1–0.6 | 102 | 0.25 | 0.27 |
| 0.7–1.2 | 80 | 6.3 | 0.0 |
| 1.2 | 55 | 3.8 | 0.02 |
| 1.4 | 52 | 8.9 | 0.0 |
| 0.7–1.4 | 68 | 7.5 | 0.0 |

This process produces less foam than a base hydrolysis process in which DMSO is not employed to first dissolve the high explosive. Processing rates of up to 10.5 kg/day were achieved using the 50-gallon reactor of this example. It is likely that processing rates of over 40 kg/day could be achieved using a 200-gallon reactor.

Two waste streams resulted from the scaled up DMSO/base hydrolysis process: (1) a filtered liquid effluent and (2) a small amount of unreacted HMX that remained on the filter media. Laboratory analysis of the liquid effluent from both processes showed that no explosive material remained. Consequently, the waste was drummed into 55-gallon containers and disposed by a commercial firm.

The liquid waste produced from these reactions is a "non-regulated" waste (in the sense used in the Resource Conservation and Recovery Act (RCRA)) and was routinely removed through the plant's waste-handling system, because it contains no toxic or hazardous components.

Example 6

This example provides an approximate calculation of the heat of the exothermic hydrolysis reaction described in Example 1 above. In that example, an explosive-containing solution was prepared by adding 237 g of PBX 9404 to 1000 mL of DMSO. To 20 mL of a 9 M aqueous NaOH solution, the explosive-containing solution was added in 3 mL aliquots until 27 mL had been added and the temperature of the reaction mixture began rising in an uncontrolled fashion to 68° C. The reaction was conducted in a beaker immersed in a water bath. The heat of the hydrolysis reaction was estimated using the following calculations:

1. Heat absorbed by the reaction mixture as its temperature rose to 68° C:

$$[(27+20)\text{mL}\times(68-23)^\circ\text{ C.}](1\text{ g/mL})(1\text{ cal/g}^\circ\text{ C.})=2115\text{ cal}$$

2. Amount of explosives in the reaction mixture (i.e., in 27 mL of the DMSO solution):

a. HMX $$(27\ \text{mL})\frac{(237\ \text{g PBX 9404})(94\ \text{g HMX})(1\ \text{mol HMX})}{(1131\ \text{mL of solution})(100\ \text{g PBX 9404})(296\ \text{g HMX})} = 18.0\ \text{mmol}$$

b. Nitrocellulose (NC)

$$(27\ \text{mL})\frac{(237\ \text{g PBX 9404})(3\ \text{g NC})(1\ \text{mol NC})}{(1131\ \text{mL of solution})(100\ \text{g PBX 9404})(227\ \text{g NC})} = 0.75\ \text{mmol}$$

Total moles of explosives in reaction: 18.75 mmol

3. Heat of reaction: $2.115\ \text{kcal}/(18.75\times10^{-3}\ \text{mol}) =$ 113. kcal/mol

Example 7

The preceding examples have each dealt with base hydrolysis of high explosives, primarily HMX-based explosives formulations, taken from virgin explosives stock. This example, however, demonstrates the destruction of a waste stream containing high explosives from a demilitarized W48 nuclear weapons system. In this context, demilitarization is defined as an irreversible modification or destruction of a component or part of a component to the extent required to prevent revealing classified or otherwise controlled information. The W48 nuclear weapons system featured in this example employed the PBX 9404 explosives formulation, consisting of 94% HMX high explosive, 3% nitrocellulose binder, 3% CEF plasticizer, and a trace of diphenylamine as a stabilizer to the nitrocellulose.

The waste stream from the W48 nuclear weapons system came from a solvent dissolution process wherein DMSO was used to remove explosives from the physics package. The concentration of explosives in DMSO in all experiments of this example was less than 17%. by weight. The full-scale (200 gallon reactor) chemical hydrolysis process digested the explosive with efficiencies ranging above 99%. After each study the hydrolysate was filtered and any residual HMX was removed and added to subsequent batches and hydrolyzed. Following filtration the hydrolysate was analyzed for HMX, which was usually found to be present at levels of less than 200 ppm.

This residual level (200 ppm) meets Department of Transportation (DOT) requirements for the definition of "non-explosive." When no DOT explosives characteristic is associated with the hydrolysate, the corresponding Resource Conservation and Recovery Act (RCRA) D003 hazardous waste chracterization for reactivity for HMX-based explosives no longer applies. If there are no other RCRA constituents detected in the hydrolysate, it may be disposed of as a class I non-hazardous waste.

The studies were performed in glass-lined Pfaudler chemical reactors ranging in size from 50 to 200 gallons. The reactors were equipped with agitators, steam jackets for heating, temperature monitors, view ports, and point-source ventilation. The off-gasses passed through a scrubbing system located on the roof of the building which removed particulates and water-soluble gases from the venting air stream. Liquid effluent from the completed reactions were vacuum filtered on a ceramic filter crock. The filter medium was a five-micron, nylon filter cloth with a filter paper backing.

Essentially the same processes and materials that were used in the laboratory were scaled-up in the pilot plant. To assure complete hydrolysis of the high explosive, about a 10% excess NaOH solution was used and the reactor was held at hydrolysis temperature between 50 and 93° C.) for 1 to 6 hours after adding the PBX-9404. All process took place at ambient pressure. After the solutions cooled to ambient, they were neutralized to a pH of 6 to 8 using either concentrated sulfuric acid or dilute hydrochloric acid, then they were filtered. The filtrate was transferred into 55-gal drums for later disposal.

One conclusion from this study is that glues and sealants associated with explosives from dismantled nuclear weapons do not affect the operating parameters that were developed with virgin or non-nuclear weapons explosives. Table 9 is a tabulation of data that was obtained when liquid samples were sent off-site for analyses of RCRA constituents by an independent Environmental Protection Agency (EPA)-certified laboratory. Another conclusion that can be drawn from this data is that the glues and sealants do affect the RCRA analyses. There are several chemicals that are present (although in very minute quantities) that were not present in analyses performed on hydrolysate from studies with virgin explosives.

The goals of this example were: (1) to demonstrate DMSO/base hydrolysis technology on a pilot plant scale; (2) determine if the DMSO/base hydrolysis process developed and optimized for virgin or non-nuclear weapons explosives could be used on explosives from dismantled nuclear weapons (these explosives also contain glues and sealants); (3) obtain air emissions data; and (4) send liquid samples of the hydrolysate off-site for analysis of RCRA constituents by an independent EPA-certified laboratory.

The Sample 1 process run consisted of approximately 40 gallons of 12% by weight PBX 9404 in DMSO solution. The HMX in the PBX 9404/DMSO solution was hydrolyzed by controlled addition into a heated aqueous sodium hydroxide solution. Rates of addition of the PBX 9404/DMSO solution to the heated aqueous sodium hydroxide solution ranged from below 2 liters/minute to 2 to 4 liters/minute. An air-operated peristaltic-type pump was used to deliver the PBX 9404/DMSO solution.

The Sample 2 process run consisted of approximately 40 gallons of 15% by weight PBX 9404 in DMSO solution. Additional sodium hydroxide solution was used in this process run to account for the slightly higher percentage of PBX 9404 present in solution. Rates of addition of the PBX 9404/DMSO solution to the heated aqueous sodium hydroxide solution ranged from 1.2 liters/minute to 3 liters/minute. An air-operated Teflon™ double diaphragm-type pump was used to deliver the PBX 9404/DMSO solution.

After the hydrolysis process was completed and the effluent filtered, traces of an elastomeric material from the W48 program were noted on the filter.

TABLE 9

Gas Analysis, % by Weight, DMSO/Base Hydrolysis of PBX 9404 from W48 Nuclear Weapons System.

| ANALYTE>> | $N_2$ | $O_2$ | $H_2O$ | Ar | $CO_2$ | $N_2O$ | $H_2$ | NO | $CH_4$ | $CH_2O$ | $CH_3OH$ | $NH_3$ |
|---|---|---|---|---|---|---|---|---|---|---|---|---|
| Sample 1 | 24.97 | 0.97 | 1.53 | 0.05 | 0.0 | 71.09 | 0.0 | 0.31 | 0.0 | 0.00 | 0.76 | 0.32 |
| Sample 2 | 16.44 | 0.17 | 1.49 | 0.02 | 0.0 | 77.65 | 0.04 | 0.20 | 0.03 | 0.00 | 0.29 | 3.67 |

In Tables 11 and 12, the values preceded by the "less than" symbol (<) indicate the element or compound could not be detected; and the values shown after the symbol give the detection limits, adjusted for dilution if necessary. For a given element or compound, the detection limit of the instrument is a constant, but the reported detection limit pertains to a particular sample and depends upon whether the sample had to be diluted prior to analysis or not. For example, the detection limit for most volatile organics is 0.005 mg/L, which is the limit of detection for the instrument itself. But some of the samples were diluted by a factor of two before analysis, so for those samples the detection limit was reported as 0.010 mg/L to indicate that 0.010 mg/L was the concentration that would have had to be present in the sample before dilution for the instrument to detect it. Similarly, samples that were diluted ten times are shown to have detection limits of 0.05 mg/L instead of 0.005 mg/L.

Most of the elements or compounds tested for were absent or undetectable. For those elements or compounds that were detected, the measured concentration is shown in bold type. Blank spaces in the tables indicate that the analytical laboratory did not analyze for that particular element or compound.

All analyses were performed by an independent EPA-certified analytical laboratory, which employed the test methods in Table 10. The metals detected are associated with the sodium hydroxide.

TABLE 10

| Constituent | Test Method |
|---|---|
| cyanide/reactive cyanide | EPA 353.3 |
| phosphate | EPA 365.2 |
| volatile organics | EPA 8260 |
| semi-volatile organics | EPA 8270 |
| ammonia | EPA 350.3 |
| metals | EPA 6010 |
| total organic carbon | ASTM D4129 |
| total halogenated carbon | EPA 9020 |
| nitrate/nitrite | EPA 353.2 |

The acetone detected is associated with the manufacture of HMX. In the process, acetone is used to recrystalize HMX and becomes entrained in the HMX molecule and is not released until the molecule is completely dissolved in a solvent. Other chemicals detected in the volatile and semi-volatile analyses are probably associated with the glues and sealants that are used to affix the explosives on the physics package. These chemicals were not detected in studies that used virgin or non-weapons explosives.

The analytical laboratory reported 1300 mg/kg reactive cyanide in sample D00531. This result is considered to be unreliable. The phosphorus and total organic halide values are associated with the CEF in PBX 9404. The total organic carbon values include the breakdown products of sodium formate and carbonate.

TABLE 11

Analyses of Semivolatile Organics, mg/L

| Compound | W48 System |
|---|---|
| phenol | <46 |
| bis(2-chloroethyl) ether | <46 |
| 2-chlorophenol | <46 |
| 1,3-dichlorobenzene | <46 |
| 1,4-dichlorobenzene | <46 |
| benzyl alcohol | <46 |
| 1,2-dichlorobenzene | <46 |
| 2-methylphenol | <46 |
| bis(2-chloroisopropyl) ether | <46 |
| 4-methylphenol | <46 |
| N-nitroso-di-n-propylamine | <46 |
| nitrobenzene | <46 |
| isophorone | <46 |
| 2,4-dimethylphenol | <46 |
| benzoic acid | <230 |
| bis(2-chloroethoxy) methane | <46 |
| 2,4-dichlorophenol | <46 |
| 1,2,4-trichlorobenzene | <46 |
| naphthalene | <46 |
| 4-chloroaniline | <46 |
| hexachlorobutadiene | <46 |
| 4-chloro-3-methylphenol | <46 |
| 2-methylnaphthalene | <46 |
| hexachlorocyclopentadiene | <46 |
| 2,4,6-trichlorophenol | <46 |
| 2,4,5-trichlorophenol | <230 |
| 2-chloronaphthalene | <46 |
| 2-nitroaniline | <230 |
| dimethyl phthalate | <46 |
| acenaphthylene | <46 |
| 3-nitroaniline | <230 |
| acenaphthene | <46 |
| 2,4-dinitrophenol | <230 |
| 4-nitrophenol | <230 |
| dibenzofuran | <46 |
| 2,4-dinitrotoluene | <46 |
| 2,6-dinitrotoluene | <46 |
| diethyl phthalate | <46 |
| 4-chlorophenyl phenyl ether | <46 |
| fluorene | <46 |
| 4-nitroaniline | <230 |
| 4,6-dinitro-2-methylphenol | <230 |
| N-nitrosodiphenylamine | <46 |
| 4-bromophenyl phenyl ether | <46 |
| hexachlorobenzene | <46 |
| pentachlorophenol | <230 |
| phenanthrene | <46 |
| anthracene | <46 |
| di-n-butyl phthalate | <46 |
| fluoranthene | <46 |
| pyrene | <46 |
| butyl benzyl phthalate | <46 |
| 3,3'-dichlorobenzidine | <230 |
| benzo(a)anthracene | <46 |
| bis(2-ethylhexyl) phthalate | <46 |
| chrysene | <46 |
| di-n-octyl phthalate | <46 |
| benzo(b)fluoranthene | <46 |
| benzo(k)fluoranthene | <46 |
| benzo(a)pyrene | <46 |
| indeno(1,2,3-cd)pyrene | <46 |
| dibenzo(a,h)anthracene | <46 |

TABLE 11-continued

| Analyses of Semivolatile Organics, mg/L | |
|---|---|
| Compound | W48 System |
| benzo(g,h,i)perylene | <46 |
| 2-nitrophenol | |
| hexachloroethane | |
| benzidine | |
| N-nitrosodimethylamine | |
| total organic carbon | |

TABLE 12

| Analyses of Inorganic Elements and Compounds, mg/L | | |
|---|---|---|
| | W48 Program | |
| Element | Sample 1 | Sample 2 |
| aluminum | <10 | 10 |
| antimony | <5.0 | <5 |
| arsenic | <0.10 | |
| barium | <0.50 | <5 |
| beryllium | <0.050 | <0.5 |
| boron | <1.0 | 30 |
| cadmium | 0.050 | <0.5 |
| calcium | 4.0 | 170 |
| chromium | 0.32 | 0.6 |
| cobalt | <0.050 | <0.5 |
| copper | 8.1 | 6.0 |
| iron | 3.8 | 18 |
| lead | 0.14 | |
| magnesium | <5.0 | 14 |
| manganese | 0.10 | 1.5 |
| mercury | <0.0005 | |
| molybdenum | <0.050 | <1 |
| nickel | 2.0 | 14 |
| potassium | <50 | 100 |
| scandium | <0.50 | <0.5 |
| selenium | <5.0 | |
| silicon | <50 | 55 |
| silver | <0.050 | <0.5 |
| sodium | 22000 | 300000 |
| strontium | <0.10 | 2 |
| thallium | <10 | <10 |
| tin | <3.0 | 49 |
| titanium | <0.10 | <1 |
| vanadium | <0.050 | <0.5 |
| zinc | 6.0 | 35 |
| ammonia (as N) | 1900 | |
| cyanide, total | 28 | |
| reactive cyanide | <0.5 | 1300 |
| nitrate + nitrite (as N) | 6700 | |
| phosphorus | 23 | |
| total organic carbon | 140000 | |
| total organic halide | 270 | |

Example 3

This example shows a cost analysis for implementing the inventive DMSO/base hydrolysis process for treating high explosives and related energetic materials, as compared with a conventional alkaline hydrolysis process. Table 13 displays the results in 1996 U.S. dollars.

TABLE 13

| Cost Estimate/Comparison For Operating Two Different Base Hydrolysis Processes<br>Comparison of Two Processes, Each to Destroy 100 lbs. of Explosives | | | | | |
|---|---|---|---|---|---|
| Process | Step | Operator hr | Supervisor hr | Cost, $ | Cost/lb. $ |
| Alkaline Hydrolysis | I. Prepare explosives | 32 | 26 | 5,095 | 50.95 |
| | II. Move explosives | 2 | 3 | 337 | 3.37 |
| | III. Treat with caustic | 42 | 22 | 5,585 | 55.85 |
| | IV. Move hydrolysate | 2 | 1 | 615 | 6.15 |
| | V. Dispose of hydrolysate | 0 | 1 | 385 | 3.85 |
| | | | Total cost: | 12,017 | 120.17 |
| DMSO/Base Hydrolysis | I. Perform hydrolysis | 38 | 18 | 4,777 | 47.77 |
| | II. Move hydrolysate | 2 | 1 | 615 | 6.15 |
| | III. Dispose of hydrolysate | 0 | 1 | 385 | 3.85 |
| | | | Total cost: | 5,777 | 57.77 |

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed methods and devices may be utilized in various combinations and/or independently. Thus the invention is not limited to only those combinations shown herein, but rather may include other combinations.

REFERENCES

The following references, to the extent that they provide exemplary procedural or other details supplementary to those set forth herein, are specifically incorporated herein by reference.

Byrd and Humphreys, *Proceedings of the* 12*th International Incineration Conference*, Knoxville, Tenn., May 3–7, 1993, pp 621–624.

Heilmann, Stenstrom, Hessehnann, Wiesmann, *Wat. Sci. Tech.* 1994, 30(3) 53–61.

Heilmann, Wiesmann, Stenstrom, *Environ. Sci. and Technol.* 1996, 30, 1485–1492.

Holl, Schneider, *Contaminater Soil* '93, Arendt, Annokkee, Bosman, van den Brink, Eds.; Kluwer: Dordecht (The Netherlands), 1993; pp 941–942.

McLellan, Hartley, Brower *Health Advisory For Hexahydro*-1,3,5-*trinitro*-1,3,5-*triazine*; Technical Report PB-90-273533; Office of Drinking Water, U.S. Environmental Protection Agency: Washington, D.C., 1988a.

McLellan, Hartley, Brower *Health Advisory For Octahydro*-1,3,5,7-*tetranitro*-1,3,5,7-*tetrazine*; Technical Report PB-90-273525; Office of Drinking Water, U.S. Environmental Protection Agency: Washington, D.C., 1988b.

Spontarelli, Buntain, Sanchez, Benziger *Proceedings of the* 12*th International Incineration Conference*, Knoxville, Tenn., May 3–7, 1993, pp 787–791.

What is claimed is:

1. A method for hydrolyzing an explosive, comprising the steps of:

completely dissolving said explosive in a polar, aprotic organic solvent to form an explosive-containing solution; and then adding said explosive-containing solution to a basic aqueous solution to form a mixture, such that said explosive is hydrolyzed.

2. The method of claim 1, wherein said polar, aprotic organic solvent comprises dimethylsulfoxide.

3. The method of claim 2, wherein said mixture comprises from about 65% to about 85% dimethylsulfoxide by volume.

4. The method of claim 1, wherein said explosive comprises at least one of 1,3,5,7-tetraaza-1,3,5,7-tetranitrocyclooctane, 1,3,5-triaza-1,3,5-trinitrocyclohexane, 2,4,6-trinitrotoluene, or a mixture thereof.

5. The method of claim 4, wherein said explosive comprises 1,3,5,7-tetraaza-1,3,5,7-tetranitrocyclooctane.

6. The method of claim 5, wherein said explosive comprises less than about 450 g 1,3,5,7-tetraaza-1,3,5,7-tetranitrocyclooctane per liter of dimethylsulfoxide.

7. The method of claim 6, wherein said explosive comprises from about 200 g to about 280 g 1,3,5,7-tetraaza-1,3,5,7-tetranitrocyclooctane per liter of dimethylsulfoxide.

8. The method of claim 4, wherein said explosive comprises 1,3,5-triaza-1,3,5-trinitrocyclohexane.

9. The method of claim 8, wherein said explosive comprises less than about 460 g 1,3,5-triaza-1,3,5-trinitrocyclohexane per liter of dimethylsulfoxide.

10. The method of claim 9, wherein said explosive comprises from about 200 g to about 280 g 1,3,5-triaza-1,3,5-trinitrocyclohexane per liter of dimethylsulfoxide.

11. The method of claim 4, wherein said explosive comprises 2,4,6-trinitrotoluene.

12. The method of claim 11, wherein said explosive comprises less than about 435 g 2,4,6-trinitrotoluene per liter of dimethylsulfoxide.

13. The method of claim 12, wherein said explosive comprises from about 200 g to about 280 g 2,4,6-trinitrotoluene per liter of dimethylsulfoxide.

14. The method of claim 1, wherein said explosive further comprises at least one of a binder, a plasticizer, a stabilizer, or a mixture thereof.

15. The method of claim 14, wherein said binder comprises nitrocellulose.

16. The method of claim 14, wherein said binder comprises a fluoroelastomer.

17. The method of claim 14, wherein said plasticizer comprises tris(2-chloroethyl) phosphate.

18. The method of claim 14, wherein said stabilizer comprises diphenylamine.

19. The method of claim 14, wherein said binder comprises nitrocellulose, said plasticizer comprises tris(2-chloroethyl) phosphate, and said stabilizer comprises diphenylamine.

20. The method of claim 1, wherein said basic aqueous solution comprises from about 1 M to about 15 M sodium hydroxide.

21. The method of claim 1, wherein said basic aqueous solution comprises from about 8 M to about 10 M sodium hydroxide.

22. The method of claim 1, wherein said basic aqueous solution is maintained at a temperature between about 20° C. and about 100° C.

23. The method of claim 22, wherein said basic aqueous solution is maintained at a temperature between about 60° C. and about 90° C.

24. The method of claim 1, wherein said explosive-containing solution is maintained at a temperature between about 20° C. and about 100° C.

25. The method of claim 1, wherein a rate of adding said explosive-containing solution to said basic aqueous solution is controlled to minimize a foaming of said mixture.

26. The method of claim 1, wherein a rate of adding said explosive-containing solution to said basic aqueous solution is controlled to regulate a temperature of said mixture.

27. The method of claim 1, wherein said explosive further comprises at least one of a glue, a sealant, or a mixture thereof.

28. The method of claim 1, wherein said explosive comprises at least one of explosive-contaminated soil, explosive-contaminated processing water, explosive-contaminated groundwater, or a mixture thereof.

29. A method for hydrolyzing an explosive to form hydrolysis products, comprising the steps of:

completely dissolving said explosive in a polar, aprotic organic solvent to form an explosive-containing solution;

then adding said explosive-containing solution to a basic aqueous solution to form a reaction mixture, such that said explosive is hydrolyzed;

then adding an acidic aqueous solution to said reaction mixture to neutralize said basic aqueous solution; followed by separating said hydrolysis products from said reaction mixture;

separating said polar, aprotic organic solvent and an aqueous phase from said reaction mixture; and then recycling said polar, aprotic organic solvent and said aqueous phase.

30. A method for hydrolyzing an energetic material to form hydrolysis products, comprising the steps of:

completely dissolving said energetic material in a polar, aprotic organic solvent to form an energetic material-containing solution;

then adding said energetic material-containing solution to a basic aqueous solution to form a reaction mixture, such that said energetic material is hydrolyzed;

then adding an acidic aqueous solution to said reaction mixture to neutralize said basic aqueous solution; followed by separating said hydrolysis products from said reaction mixture;

separating said polar, aprotic organic solvent and an aqueous phase from said reaction mixture; and then recycling said polar, aprotic organic solvent and said aqueous phase.

* * * * *